United States Patent [19]

Faldi

[11] 4,338,042

[45] Jul. 6, 1982

[54] APPARATUS FOR THE SUBAQUEOUS ENTRENCHING OF PIPES

[75] Inventor: Giovanni Faldi, Firenze, Italy

[73] Assignee: Epi Pneuma Systems S.p.A., Firenze, Italy

[21] Appl. No.: 201,306

[22] Filed: Oct. 27, 1980

Related U.S. Application Data

[63] Continuation of Ser. No. 22,649, Mar. 21, 1979, abandoned.

[30] Foreign Application Priority Data

Mar. 22, 1978 [IT] Italy ..... 21459 A/78
Jun. 14, 1978 [IT] Italy ..... 24581 A/78

[51] Int. Cl.[3] ..... F16L 11/00; B63B 35/04

[52] U.S. Cl. ..... 405/161; 37/63; 405/164

[58] Field of Search ..... 405/158-164, 405/179, 181, 182; 37/61-67, 58, 80, 81, 86

[56] References Cited

U.S. PATENT DOCUMENTS

| | | | |
|---|---|---|---|
| 3,004,392 | 10/1961 | Symmark | 405/162 X |
| 3,103,790 | 9/1963 | Popich | 405/162 |
| 3,287,922 | 11/1966 | Harmstorf | 405/182 |
| 3,423,946 | 1/1969 | Maclay | 405/164 |
| 3,429,132 | 2/1969 | Martin | 405/161 |
| 3,505,826 | 4/1970 | Harmstorf | 37/63 X |
| 3,540,226 | 11/1970 | Sherrod | 405/164 |
| 3,583,170 | 6/1971 | De Vries | 405/162 |
| 3,590,589 | 7/1971 | Smulders | 405/161 |
| 3,624,933 | 12/1971 | Faldi | 37/63 |
| 3,673,808 | 7/1972 | Volbeda | 405/161 |
| 3,803,541 | 4/1974 | Kaisuhe Shiro | 367/107 X |
| 3,803,856 | 4/1974 | Faldi | 405/161 |
| 3,824,798 | 7/1974 | Shiroyama et al. | 405/164 |
| 3,857,250 | 12/1931 | Di Tella et al. | 405/160 |
| 3,898,852 | 8/1975 | Ezoe et al. | 405/164 |
| 3,926,003 | 12/1975 | Norman | 405/163 |

FOREIGN PATENT DOCUMENTS

| | | | |
|---|---|---|---|
| 1348487 | 3/1974 | United Kingdom | 405/163 |

*Primary Examiner*—Dennis L. Taylor
*Attorney, Agent, or Firm*—McAulay, Fields, Fisher, Goldstein & Nissen

[57] ABSTRACT

The invention relates to an apparatus for the entrenching of pipes in underwater beds, of the type in which a framework, provided with excavating means, is positioned across the pipe to be entrenched and dragged along the pipe so as to excavate two parallel trenches adjacent to both sides of the pipe, the pipe being entrenched due to the collapsing (either spontaneous or caused by disgregating means) of the bed zone thus remaining under the pipe already laid onto the bed. The excavated material is removed by means of a pump and discharged again, at a predetermined distance from and rearwardly of the framework, on the entrenched pipe. The framework is provided with side supporting skid members, by which furthermore the entrenching height is adjustable.

43 Claims, 12 Drawing Figures

APPARATUS FOR THE SUBAQUEOUS ENTRENCHING OF PIPES

This is a continuation, of application Ser. No. 022,649 filed Mar. 21, 1979, now abandoned.

The present invention relates to an apparatus suitable for the entrenching of pipes into underwater beds.

In several cases, such as for instance the building up of pipelines for the transportation of oil, water and gases, for the installation of submarine electrical and telephone lines, etc., the laying of pipes onto underwater, particularly submarine beds is necessary. By laying, in fact, the positioning of the pipe in a trench is meant, the pipe thus entrenched being then possibly covered again with loose material.

According to the standard technology for works of this kind, two phases were provided, namely:

(a) excavation of the trench, and (b) laying of the pipe.

In the case of underwater beds, apart from the normal problems related to the above phases, there are added those relating to keeping the trench clear for the time between the excavation and the laying of the pipe, the latter question being very difficult.

In fact, in most cases, after the trench had been prepared, a further excavation run immediately before the pipe laying was necessary, in order to restore partially collapsed or obstructed parts of the trench. A remarkable solution to this problem is the apparatus disclosed in the Italian patent No. 913,731, of the same inventor, which comprises, in combination with a submersed pump, a framework supporting the pump body and slidable along the pipe already laid onto the bed, said framework having excavating shovels adapted to carry out the excavation of two trenches, parallel and adjacent to the pipe, whereby the pipe is entrenched due to the collapsing, (either spontaneous or promoted by means of disgregating rippers), of the bed zone directly below the already laid down pipe.

In particular cases, however, even by using the above apparatus, some problems and disadvantages are still outstanding, as hereinafter shortly resumed:

(1) When the pumping bodies are of relevant size and/or the pipe to be entrenched into the bed is of small diameter, the center of gravity of the framework is raised, thus causing a precarious balance and consequently operating difficulties, especially in the presence of uneven beds.

(2) In the apparatus according to the above mentioned Italian patent, the framework slides along the pipe by means of rubber sheathed rollers, maintained into contact with the surface of the pipe. It has been however found that a greater certainty of contact between the pipe and the framework, especially when the pipe is of small diameter, is needed.

(3) In the known apparatus the excavated material is remotely discharged or dispersed in the vicinity of the framework, with the risk of a secondary pollution.

(4) In the case of the known apparatus, especially when the entrenching operation must be carried out high depths, the conditions of the sea or the water body, (such as for instance wave motion, submarine currents, tides, etc.), may relevantly hinder the operation under the usual dragging conditions. More particularly, sometimes it happens that the apparatus takes a position askew with respect to the working direction with the readily appreciable disadvantages and without the possibility of a ready and easy detection of such a condition from the dragging and controlling pontoon.

(5) In the case of beds having particular nature, such as for example beds formed by cemented sand, the action of only the excavating shovels for the preparation of the two trenches parallel to the pipe to be entrenched is not sufficient, unless more than one excavating run are carried out.

(6) In the course of the preliminary step, in which the pipe to be entrenched is laid onto the bed, several pipe lengths are joined to each other; such a joint is normally effected by providing, around the two ends to be joined, which are abutted to each other, a form of metal sheet, in which a cement mortar is poured in order to protect the joint. For several reasons, the metal sheet form remaining around the joint can be deformed and more particularly opened, thus forming subsequently an obstacle to the advancing of the entrenching apparatus.

(7) In some kinds of works and particularly in the presence of some types of beds, the dredged material entering the excavating shovels to be fed to the pumping chambers is highly viscous, whereby the feeding to the pumping chambers is difficult.

The main purpose of the present invention is that of eliminating all the above mentioned disadvantages and problems, both related to the particular nature of the beds and/or specifically pertaining to the known apparatus, the essential advantages of the apparatus according to the Italian patent No. 913,731 being at the same time maintained.

To this end, the apparatus of the present invention, of the type generally comprising a framework, which can be positioned across the pipe to be entrenched; excavating or dredging means mounted to the framework and adapted to operate along both sides of the pipe already laid onto the bed, whereby two trenches of a predetermined depth are formed, which trenches are parallel and adjacent to the pipe; possible rippers or ploughs, either fixed or retractable, adapted to disgregate the bed zone directly below the pipe; and a pump for removing the material dredged by the excavating means, is characterized in that said framework comprises:

at least two skid elements for the side support and the adjustment of the maximum excavation depth, which are symmetrically mounted with respect to the axis of the pipe to be entreched, said skid elements being continuous or discontinuous and of adjustable height with respect to the excavating or dredging means;

pairs of fore and/or aft arms, linked to the framework and maintained into permanent contact with the surface of the pipe to be entrenched through sliding contact means, preferably through rollers;

a first series of disgregating rippers, mounted to vertical rods, driven by levers actuated by ram units and movable between a rest position, in which the rippers are essentially parallel and laterally displaced with respect to the pipe, and an operating position in which the rippers engage the bed zone immediately below the pipe to be entrenched;

excavating shovels, forming said excavating means, which are mounted in pairs symmetrically with respect to the framework and in the number of two or more shovels for each side of the framework, each shovel having an excavating edge at a level predetermined and lower with respect to the level of the excavating edge of the next preceding shovel with respect to the dragging direction of the framework;

means for the adjustment of the distance between the two internal sides of the framework, said adjustment depending on the diameter of the pipe to be entrenched;

a second series of disgregating rippers, which are provided at least in the fore part of the framework and protrude downwardly, in order to engage the bed before the dredging shovels;

a tank centrally mounted to the said framework, which can be fed either with air pressure or ballast liquid;

a device with cutting disks for the cutting of algae, mounted to the fore part of the framework.

Among other features, by which the apparatus of the present invention is, either in combination or singly, characterized, the following can be cited;

(a) probe means are associated to the said first series of rippers in order to prevent any accidental damage to the pipe;

(b) the rippers or ploughs adapted to disgregate the bed zone below the pipe may be in form of side extensions of the excavating shovels, whereby the disgregating action is combined with the removal of the disgregated material by means of the pump, the rippers being then retractable, once the excavation of the side trenches has been completed;

(c) the delivery or discharge pipe for the excavated or dredged material is rearwardly extended with respect to the framework, referring to the dragging direction and thus to the dredging direction, whereby the excavated material is discharged on the already entrenched pipe at a distance not less than the distance at which the entrenched pipe has taken the final position with respect to the bed;

(d) in the case of operations involving very deep beds, the suspending cable of the framework is maintained loose, so as to absorb perturbating events, such as for instance wave motions, whereas the dragging of the framework is ensured by a cable parallel to the bed and passing through a pulley mounted to the anchoring means, the hauling speed of the rear anchoring winch being suitably adjusted;

(e) the excavating shovels and/or the aforesaid second series of rippers are provided with devices generating a vibrating motion, the joints of the shovels and/or rippers to the remaining part of the framework being suitably modified in order to allow the said vibrating motion;

(f) each excavating shovel comprises a device by which the dredged material entering the shovel, before passing to the pumping chamber, is subjected to a water stream, the flow rate and the pressure of which are suitably controlled;

(g) before each group of rollers permitting the apparatus to slide along the pipe to be entrenched, or at least before the first group of said rollers with reference to the advancing direction of the apparatus, a funnel like member is provided comprising two half elements, hinged to each other along a generatrix of the funnel like member, the latter being tapered towards the group of rollers whereby the metal sheets of the joint forms are compressed and drawn closer to the pipe, before the corresponding group of rollers is engaged therefrom:

(h) means are provided sensing the variation of the pressure acting on the sides of the framework, whereby variations of the working position of the framework are detected;

(i) the discharge end of the delivery pipe, especially in the case of the discharge on the already entrenched pipe, is suitably enlarged to promote the deposition of the discharge material without it being dispersed to the adjacent areas.

The features and advantages of the apparatus of the invention will clearly appear from the following detailed disclosure of a preferred embodiment, referring to the enclosed drawings in which.

Figure 1:
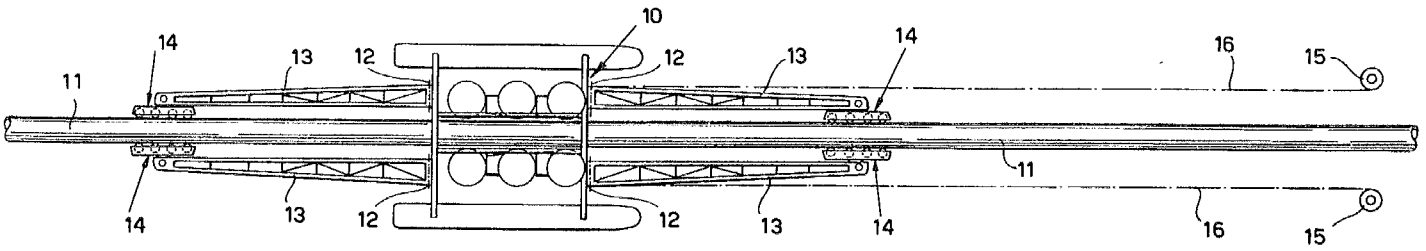
FIG. 1 is a plan view, in schematic form and from above, of the apparatus of the invention.

Firstly referring to FIG. 1, there is schematically shown the apparatus of the present invention, which comprises a framework, generically indicated by the reference 10, adapted to be positioned, in the hereinafter described manner, across the pipe 11 to be entrenched. Guide arms 13 are pivotally mounted to the framework 10, forwardly and rearwardly, by means of hinges the axes of which are indicated by the reference 12, the guide arms 13 being maintained into contact with the surface of the pipe 11 by roller carriages 14. Reference 15 indicates pulleys for the passage of dragging ropes 16, for the case of entrenching operations in deep beds as contemplated in FIG. 12, which will be more detailedly taken into consideration hereinafter. Turning now to the FIGS. 2 to 7, the entrenching apparatus is described.

As shown, the apparatus comprises a framework 10 formed by two side members 17, for example in form of two I beams, and by two laterally extended cross members 18.

To the frame, as formed by the side members 17 and the cross members 18, the pumping bodies 19 are mounted corresponding to a compressed air pump of the type disclosed in the Italian patent No. 838,495 (U.S. Pat. No. 3,624,933) of the same inventor, this patent being herein referred to for every explanation about the structure and the operation of the pumps of this type.

Dredging or excavating shovels 20, which have also been described and claimed in prior patents of the same inventor, are combined with the pumping bodies 19.

These shovels are provided with a dredging edge 21 which engages the bed for the excavation and are closed in the fore part by a grid 22 (FIG. 5) having the purpose of classifying the size of the dredged material entering the inner cavity of the shovel to pass thereafter, through the inlet connection 23, to the related pumping body 19, subjected to the opening of an inlet valve (not shown).

Both the pump and the dredging shovels are the subject of the Italian patents 838,495 and 950,389 of the same inventor, which are herein referred to for further details.

The framework 10 is furthermore completed by vertical uprights 24 and by a step-shaped lower frame, corresponding to the several operating levels of the shovels 20. Such a lower frame essentially comprises pairs of side members 25, supporting the pumping bodies and the shovels at the respective heights.

Figure 5:
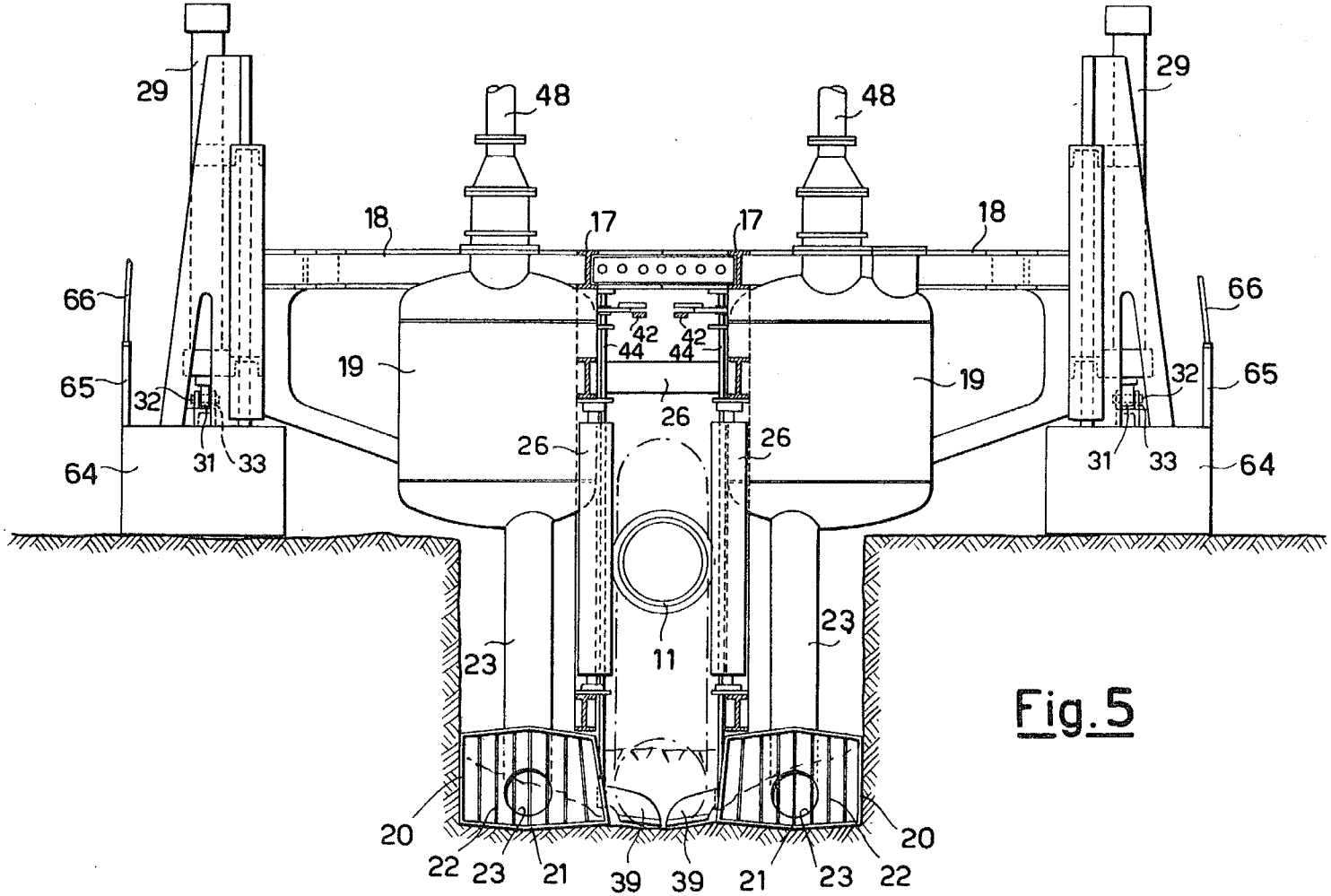
Figure 10:
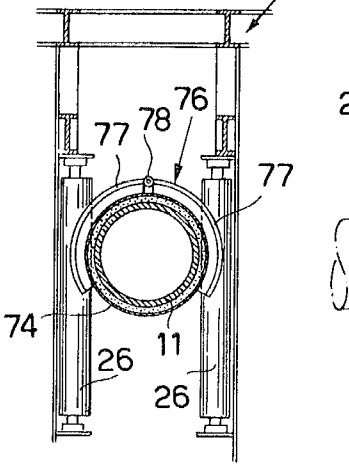

For the sliding motion of the framework along the pipe, there are provided rollers, indicated by the reference 26 and preferably having rubber sheated surface, the rollers engaging the surface of the pipe 11 in the manner illustrated in FIGS. 5 and 10.

As shown in the FIGS. 4 to 7, the cross members 18 are laterally extended in order to permit the fastening of the vertical support members 27 of skid members 28.

More particularly the support members 27 consist of a cylinder 29, for instance of the oleodynamic or pneumatic type, a piston 30 being associated thereto.

The piston 30, at its free end, is linked through the ring 31 (FIG. 4) and the pin 32, supported by the brackets 33, to the skid members (34 of FIG. 7 or 64 of FIGS. 2, 4, 5 and 6), which extend parallel to the framework and to the axis of the pipe 11, a more detailed description being given hereinafter.

Figure 7:
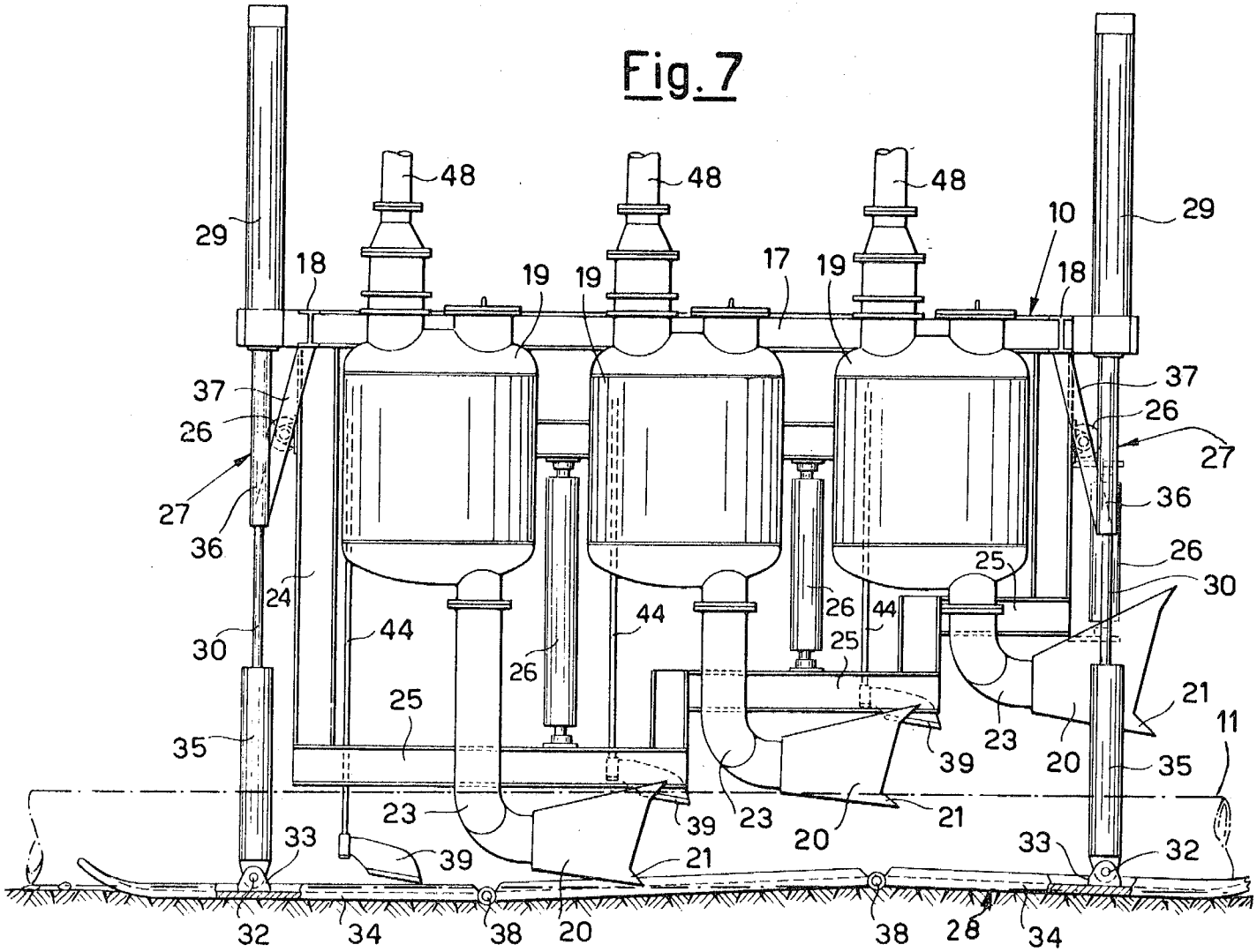
FIG. 7 is a side elevation view of another embodiment of the apparatus, in the rest condition.

As shown in FIG. 7, the end of the piston 30 is enclosed by a tubular part 35, adapted to slide with the piston in the re-entering motion in the cylinder 29, thus incorporating the cylindrical part of greater diameter 36 of the same piston, until the condition shown in FIG. 5 is reached.

Taking into account the bracing of the piston 30, as represented by the bar 37, the tubular part 35 has a slit permitting the complete reentering of the piston 30.

To the excavating shovels there is associated a first series of retractable disgregating rippers 39, which are driven to rotate between a rest position, essentially parallel to the axis of the pipe 11, and a working position in which the bed zone immediately under the pipe 11 is engaged therefrom, when the trenches laterally adjacent to the pipe itself have been excavated by the shovels 20.

Figure 3:
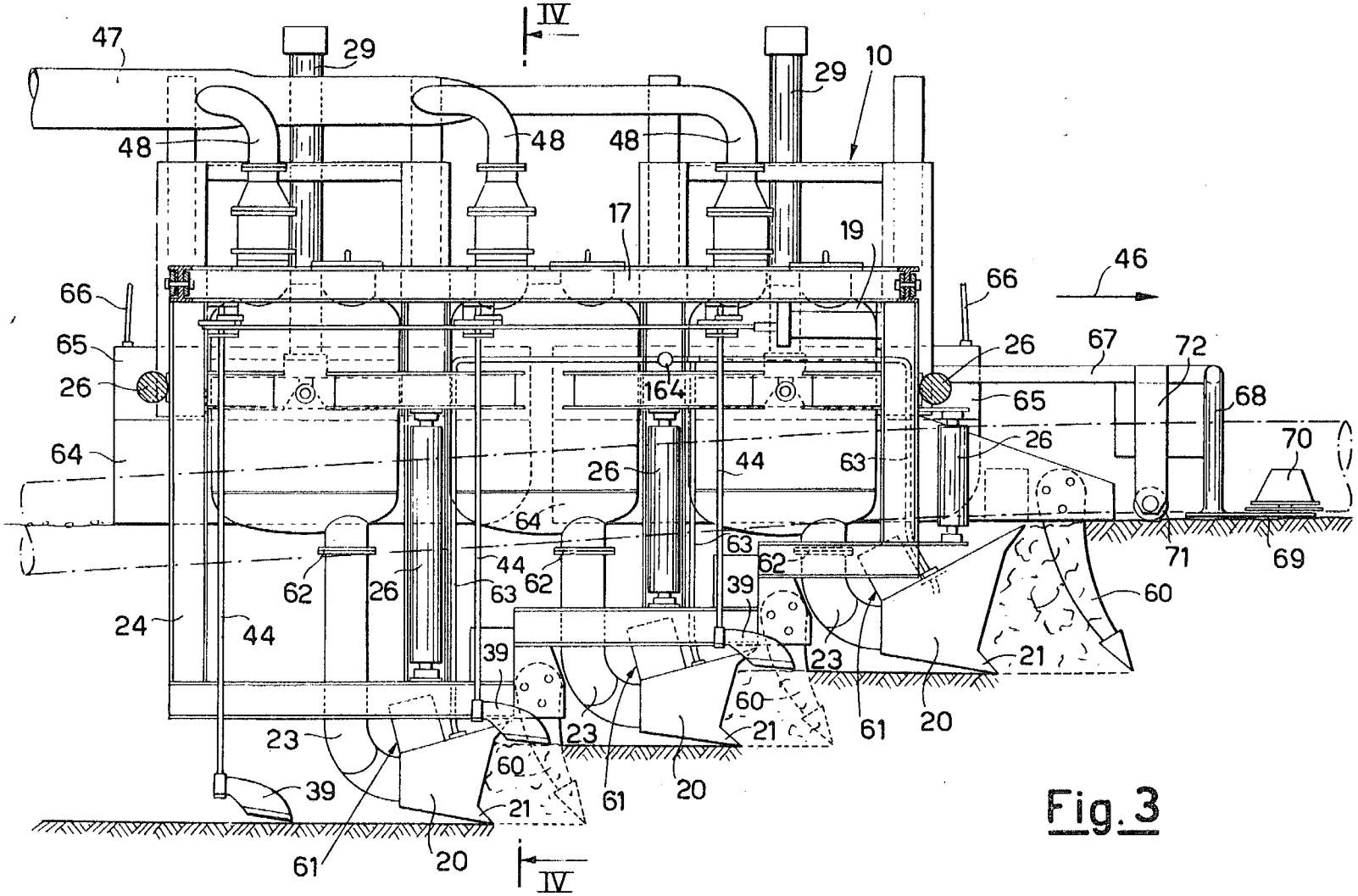
FIG. 3 is a view like FIG. 2, showing the apparatus in the operating condition.
Figure 6:
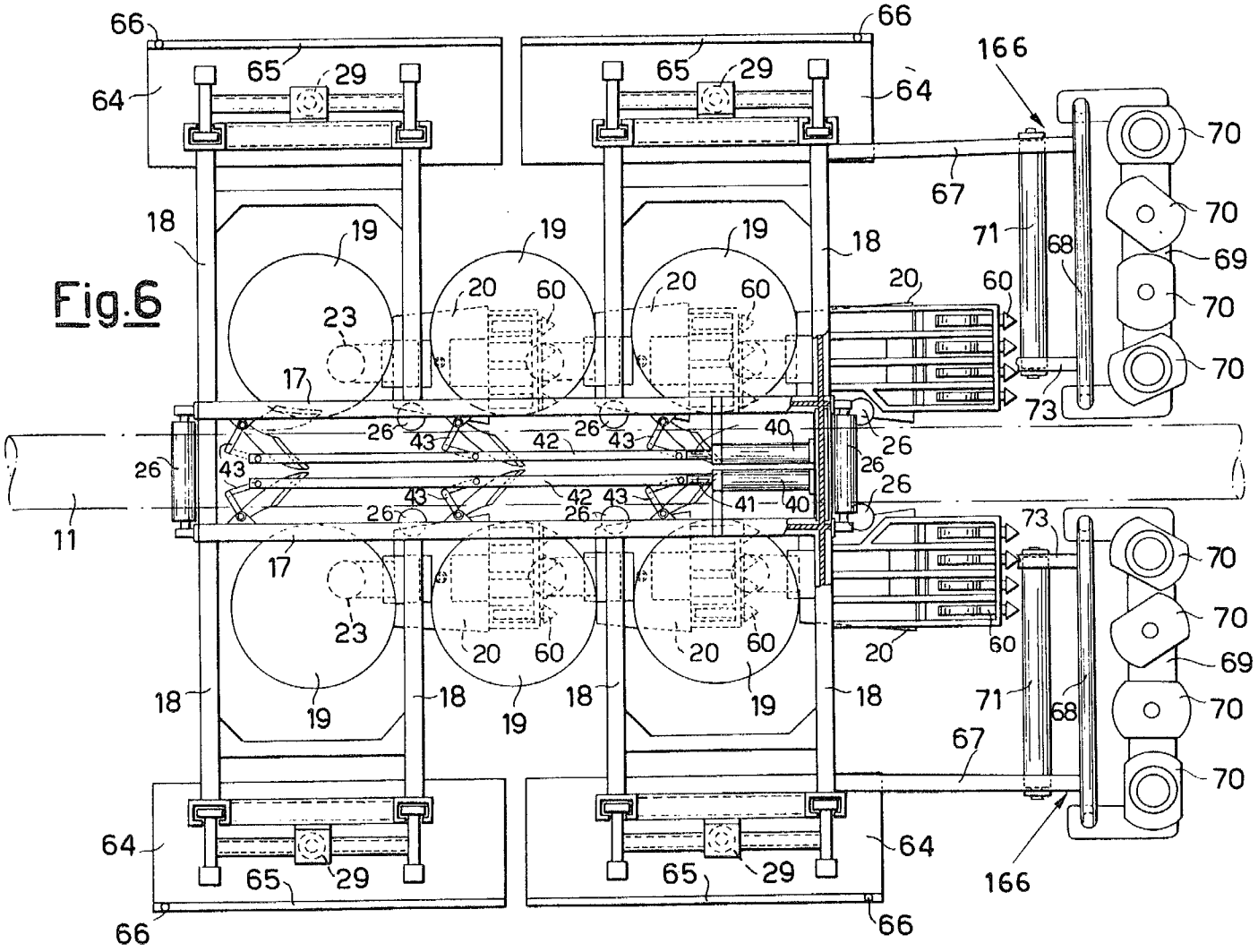
FIG. 6 is a plan view from above of the apparatus of FIG. 2.

For the control of the rippers 39 there are provided cylinders 40, the pistons 41 of which are extended by rods 42, having levers 43 pivotally linked thereto, the levers being rigidly secured to the rods 44 supporting the rippers 39 (FIGS. 3, 6 and 7).

As already mentioned, the rippers 39 are actuated only when it is required by the nature of the bed and, in order to prevent damages to the pipe 11, probe means, schematically shown by the reference 45 (FIG. 4), are preferably provided, the probe means being for example electrically connected to the ripper driving means, so as to bring the rippers 39 in the rest position in the case the probe means come into contact with the pipe 11.

It is also to be noted that, by means of the illustrated control device or of other means not shown, the disgregating rippers 39 should be movable not only between the two positions above referred to, but also reawardly retractable, especially in the case of abrupt obstacles to the disgregating action, so as to give way to the obstacle. The preceding description of the apparatus according to the present invention relates to a first simplified embodiment, such as essentially shown in FIG. 7. With further reference to this figure, the skid members 34 are formed in several lengths, connected to each other by means of hinges 38 in order to better adjust themselves to the unevennesses of the bed. Instead of the hinges 38, articulated or universal joints can be provided as well.

It is also advisable to point out the second, equally important, function of these skid members: due to their adjustability as to the height, a regulation of the excavation depth and thus of the entrenching depth of the pipe can be achieved.

Referring now more particularly to the characteristic features of the present invention, the shovels 20 are preceeded by a second series of disgregating rippers 60, forming a group before each excavating shovel, so as to penetrate the bed, which is therefore disgregated before it is engaged by the shovel 20.

Of course, the shape and the inclination of the rippers 60 is variable according to the working requirements, their function remaining unchanged. According to a not illustrated modification, the rippers 60 provided between two subsequent shovels can be fastened to both shovels, thus constituting a reinforcing member.

The action of the rippers 60 can be supplemented with that of a vibrating motion, preferably applied to the excavating shovels and/or to the rippers, by means of vibrating devices (per se well known and therefore not shown in greater detail), which are generically indicated in the drawings by the number 61.

In order to enhance the vibrating action, a joint, preferably a rubber joint of a type per se known, is preferably interposed in the flange 62 by which each shovel 20 is connected to the respective pump body 19, the joint having the aforesaid function.

In the upper wall of each shovel 20 a hole is formed for the passage of the end of a small tube 63 (FIG. 3), which partially protrudes inside the shovel, the tubes 63 being preferably connected to a common header 164, which is fed with water at adjustable pressure and flow rate.

Alternatively, instead of the small tubes 63, an opening of suitable size can be provided in the upper wall of each shovel 20, so as to permit the water to freely enter the inner cavity of the shovel, in which the dredged material is collected, during the excavation run of the shovel. It is evident that by means of the tubes 63 it is possible to dilute with the proper water amount the material as dredged from the corresponding shovel, whereby the material itself is enabled to enter without difficulties the pumping chamber connected to the cavity of the shovel by the duct 23.

Figure 4:
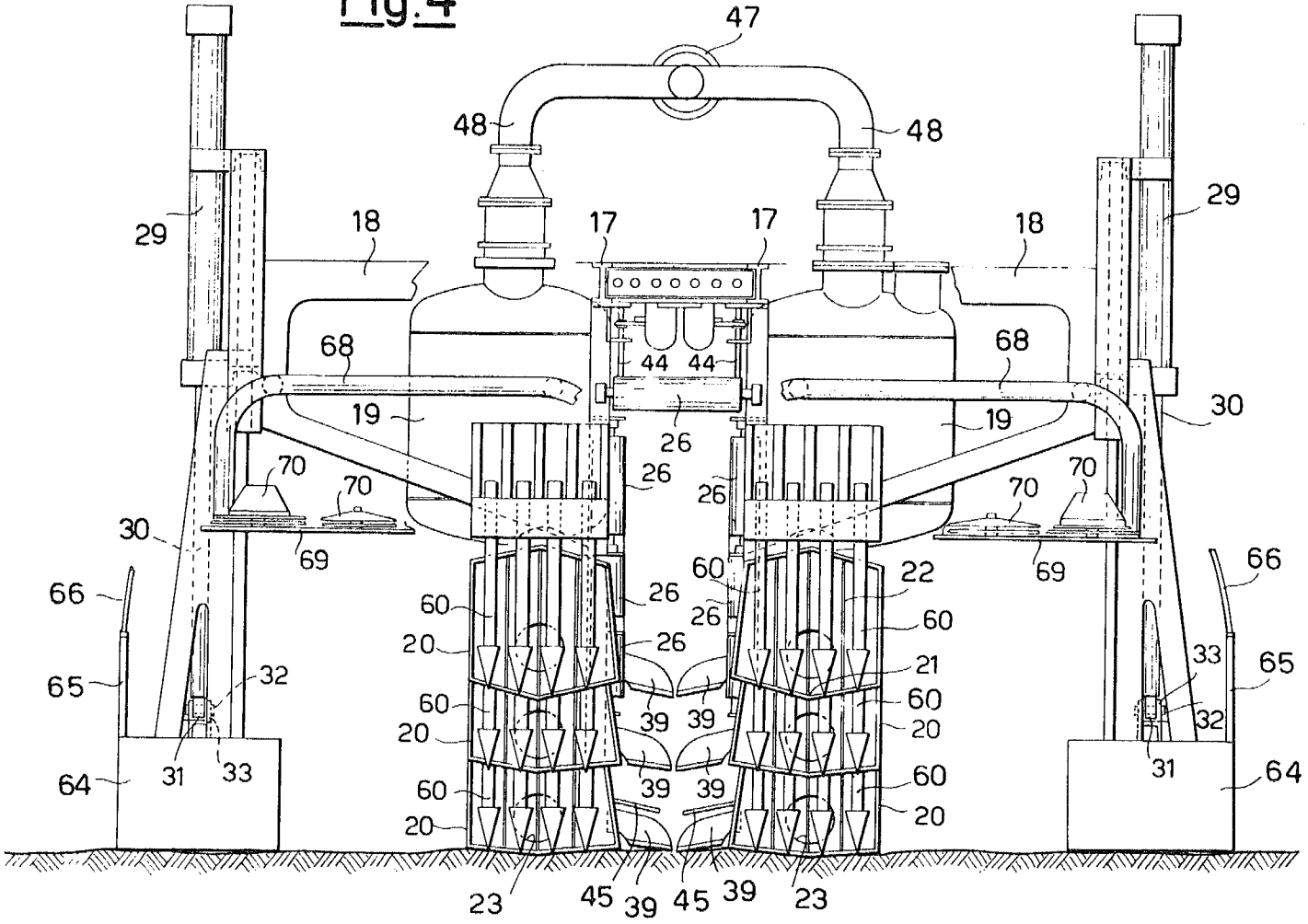
FIG. 4 and FIG. 5 are front views of the apparatus, respectively corresponding to FIG. 1 and FIG. 2.

According to the embodiment shown in FIGS. 4 and 5, the skid members of the apparatus for the entrenching of pipes are represented in form of tank shaped lengths as indicated by the reference 64, the skid members being either pivotally linked to each other or independent and adapted to be fed either with compressed air (when buoyancy is desired) or with a ballast liquid. Of course in this case too, the skid members are adjustable as to height between a rest position (in which they are completely lowered) and a working position (in which are completely or partially raised). For example, if the apparatus of the invention is used on a slimy bottom, in which the skids too might sink, the advantage of the buoyancy is self-evident. If, as a further example, the apparatus is working on a sloping bed, the excavating run being effected across the slope, it is possible to obtain a perfect balance of the framework by adjusting the buoyancy and the ballast effect, which can be obtained by properly feeding the several skids with either compressed air or ballast liquid. Like considerations and technical effects hold true for a tank mounted centrally of the framework 10 (this variant being not shown in the drawings).

As clearly shown in the FIG.S. 4, 5 and 6, to the tank shaped skids 64 there are mounted panels 65, of a type per se known, adapted to sense pressure variations and transmit them, through ducts as represented for instance by the duct 66, to suitable instruments aboard the manoeuvering and control pontoon, whereby the variation of the water pressure acting against the panel 65 is detected. Of course this embodiment has only illustrative meaning and might be substituted for by other devices having like function, namely that of signalling, through a variation of the water pressure acting on the side of the framework, if the latter, instead of advancing parallel to the pipe to be entrenched, is dragged in a different position not fulfilling the work requirements.

In the figures (particularly in FIG. 6), an auxiliary device is furthermore more shown, this device being removable with respect to the framework 10), for the cutting of algae before the dredging shovels. This device comprises two half-frames 166, each one comprising a bar 67 for the connection to the framework 10, a U shaped cross bar 68, to which the fore end of the bar 67 is secured, the ends of the cross bar 68 bearing a plate 69, generally disk shaped cutting elements 70 being rotatably mounted to the plate 69.

Rearwardly with respect to the cross bar 68 is rotatable roller 71 is provided, which is mounted between brackets 72, respectively fastened to the bar 67 and to a second bar 73.

From the FIG. 3, in accordance with the advancing direction of the apparatus as shown by the arrow 46, the operation of cutting device is readily understood.

Figure 8:
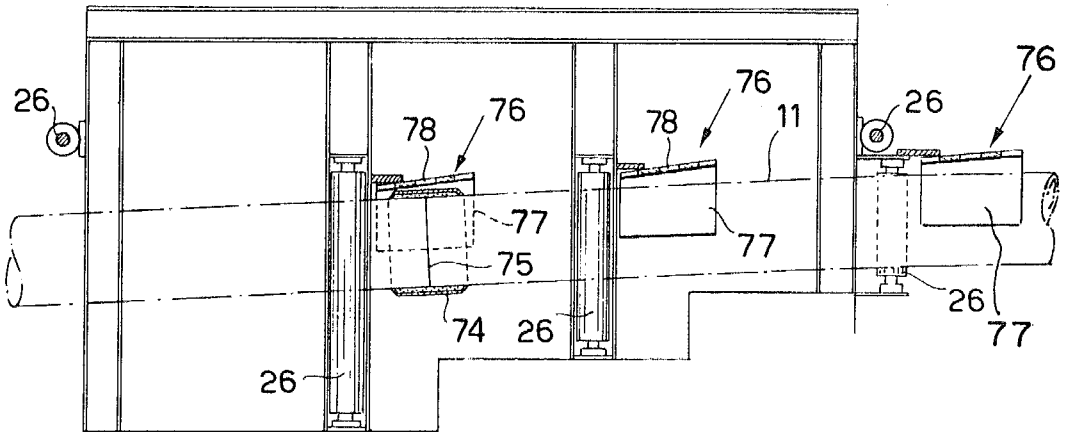
FIGS. 8, 9 and 10, are schematic and simplified views of a particular device of the apparatus of FIG. 2.
Figure 9:
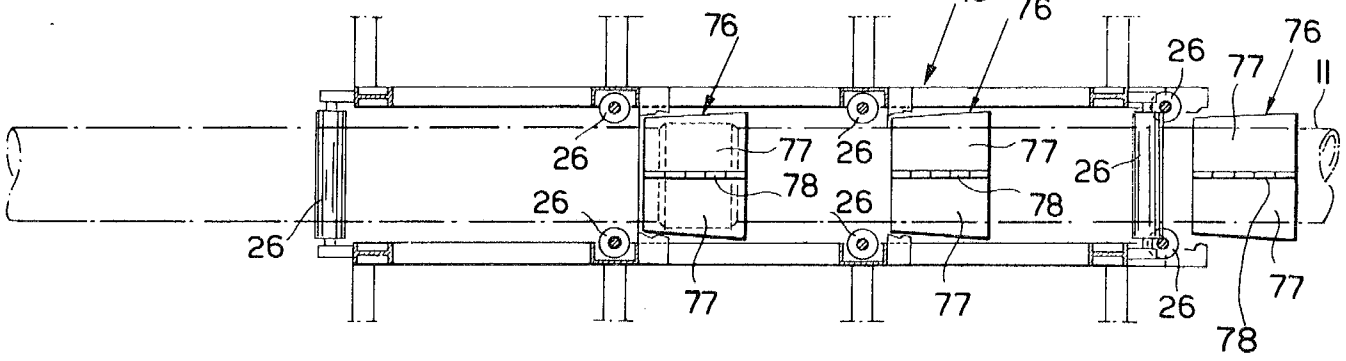

Taking lastly into consideration the FIGS. 8, 9 and 10, a device is illustrated adapted to prevent the metal sheets 74, by which the form at the joints 75 of the pipe 11 already laid onto the bed is built up, from hindering the sliding motion of the framework 10 along the pipe 11, especially at the groups of rollers 26.

Such a hindering possibility occurs since the metal sheet 74, being rather thin, is easily deformed and may open along a generatrix parallel to the pipe 11, whereby the metal sheet may be caught in the rollers 26 or in other parts of the framework, causing after all a possible damage to the pipe and/or to the entrenching apparatus.

To this end, before each group of rollers 26, a cantilevered funnel like device is mounted to the framework 10, it comprising two halves 77, hinged to each other along a generatrix by means of a hinge 78, the device 76 tapering towards the group of rollers 26.

The two halves 77 in fact surround most of the circumference of the pipe 11 and cause, as it is evident, the metal sheet 74 to remain or get doser and adherent to the surface of the pipe 11.

Of course, in practice, other embodiments of the device 76, technically and functionally equivalent to that already described, are possible and foreseable.

As regards the discharge ducts of the dredged material, as indicated by the reference 48, it is to be pointed out that they merge into only one delivery pipe 47.

Figure 12:
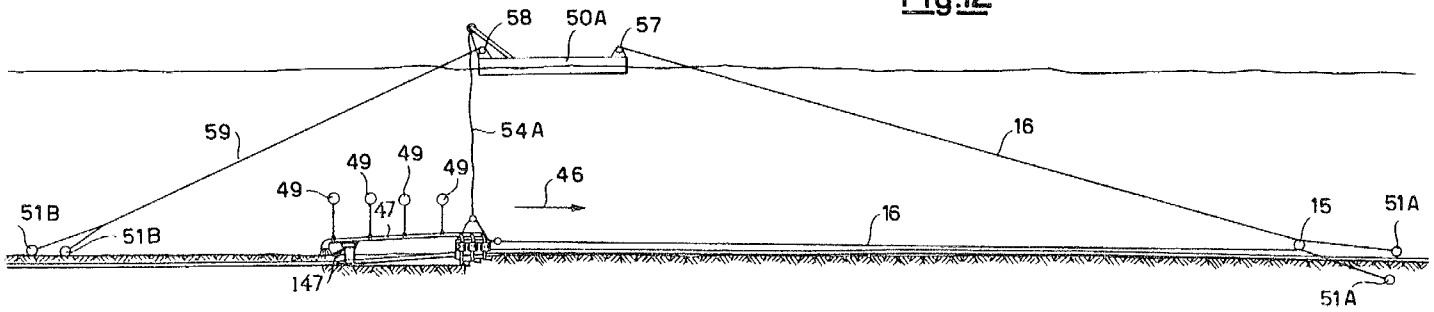
Figure 2:
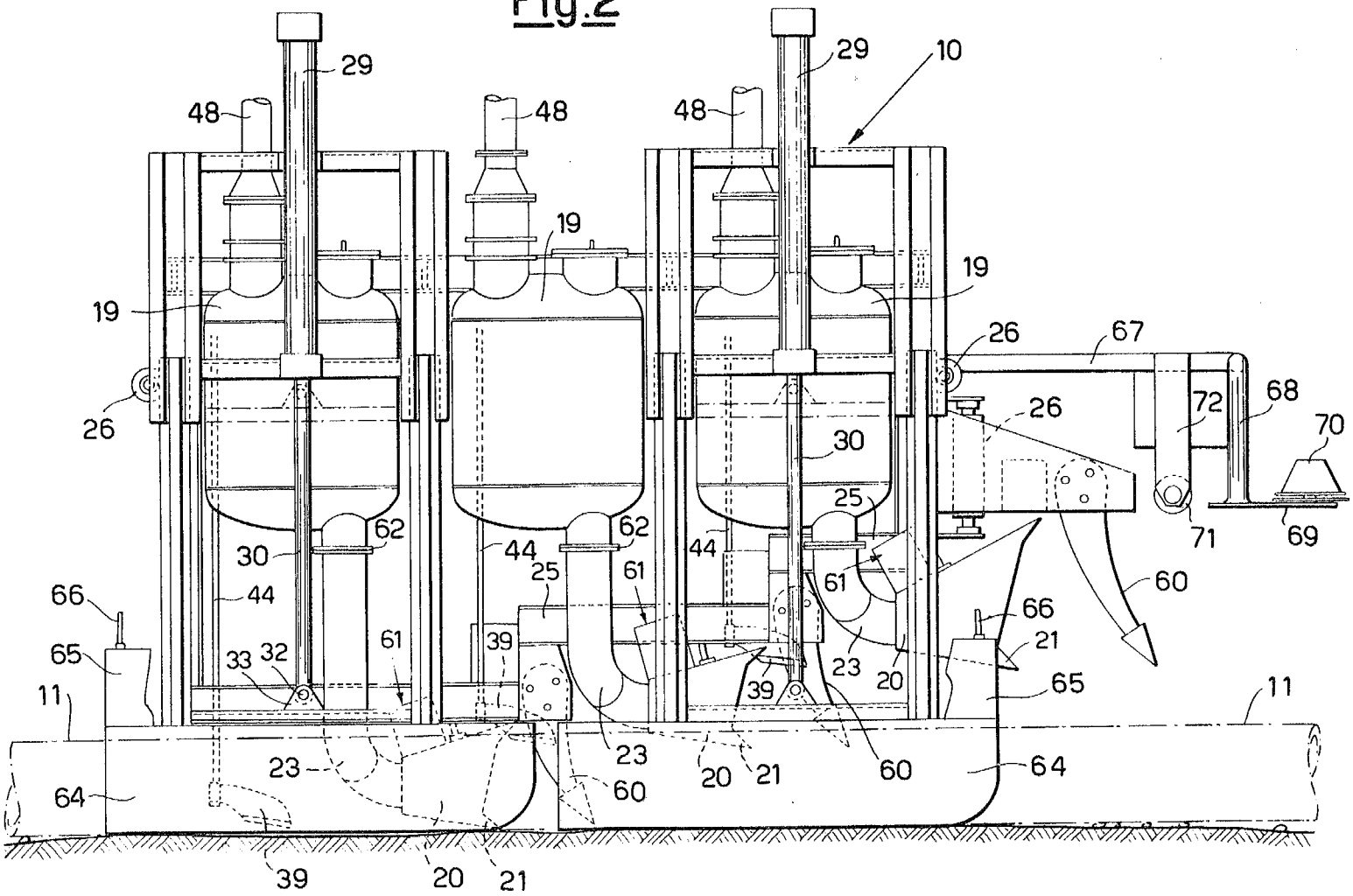
FIG. 2 is a side view of a preferred embodiment of the apparatus of the invention.

As shown in FIG. 12, the delivery pipe 47 is extended rearwardly of the framework 10 and, it being for example supported by buoys 49, discharges the same material directly onto the already entrenched pipe 11, at the point in which the pipe 11 has taken the stable final configuration with respect to the bed. When the risk of the so-called secondary pollution or in the presence of very fine dredged material, which therefore tends to remain suspended in water, the outlet or discharge end of the delivery pipe 47 is preferably enlarged, so as to essentially slow the velocity of the dredged material being discharged from this outlet and concentrate it on the already entrenched pipe, whereby the latter is covered again.

Furthermore, apart from the buoys 49, the delivery pipe 47 can be guided, so as to remain in alignment with the axis of the entrenched pipe, by means of a supporting and sliding structure, such as generically indicated by the reference 147.

Figure 11:
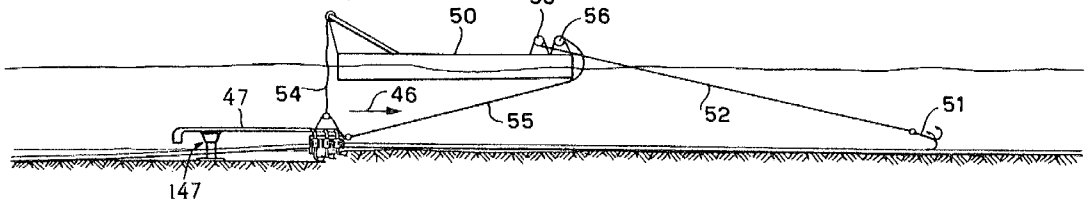
FIGS. 11 and 12 are schematic side views of the apparatus of the invention according to two operating conditions.

In the FIGS. 11 and 12, there are illustrated the two working conditions of the apparatus according to the present invention, namely entrenching in relatively shallow beds (FIG. 11) and entrenching in deep beds (FIG. 12).

In the first instance, the pontoon or watercraft 50 (bearing the auxiliary equipments, such as compressors, winches, etc.) is anchored by means of an anchor or dead weight 51, with respect to which the advancement is effected, for example through the winding of the anchoring rope 52 by means of a winch 53.

The entrenching apparatus is suspended astern of the pontoon by means of the loose rope 54 and maintained in the operating position by a connection rope 55, as controlled by a winch 56.

By suspending the apparatus by means of the loose rope 54, the objectionable effects of phenomena, such as the wave motion and the like, can be done away.

If reference is made to such a possibility, the presence of the stabilizing and adjusting skids is an essential feature.

On the contrary, in the case of FIG. 12, namely when the entrenching operation is carried out in deep beds, the watercraft 50A is anchored both at the prow and at the stern, by means of the dead weights 51A and 51B, the astern anchorage serving as a brake to the advancement so as to regularize the operation of the dredging and excavating shovels. In this case too, the apparatus is suspended to the loose rope 54A, but the dragging takes place through the rope pairs 16, passing around the pulleys 15 mounted to the dead weight 51A.

In this case the winch 57 causes the advancement to take place by winding the ropes 16, whereas the rope 59 of connection to the dead weight 51B is unwound from the braking winch 58.

Of course the revolving speeds of the winches 57 and 58 are mutually related, as a function of the desired and optimum speed of the entrenching operation.

For example, if the advancing speed of the entrenching apparatus must be 1.5 m/min, the winding of the ropes 16 by means of the dragging winch must take place at a speed of 3 linear meters per minute, whereas the rope 59 shall be unwound from the rear braking winch at a speed of 1.5 linear meters per minute.

Otherwise stated, the working speed shall be the same as the unwinding speed of the rear anchoring rope, whereas the fore dragging rope shall be wound at a speed two times the former one.

In the embodiments of the invention as hereinbefore described, reference has been made to a particular pneumatic pump; it is however contemplated that, in particular cases, depending on the type of pipe to be entrenched and on the entrenching depth of the pipe in the bed, it is possible and foreseen to substitute for the aforesaid pump a different kind of pump, in the latter case the outlet ducts of the excavating shovels being connected, according to the technique of this art, to the inlet port of the pump.

Another feature, important as well, of the apparatus of the present invention is that, the framework 10 being absolutely symmetrical with respect to the longitudinal plane passing through the axis of the pipe to be entrenched, the adjustability of the framework itself depending on the diameter of the pipe to be entrenched is possible and foreseen. In fact, it is enough to provide cross bars 18 which, in the part between the side members 17, are afforded with the possibility of inserting or removing a length of the same cross bar, the horizontal rubber sheathed rollers 26 being either likely adjustable or replaceable. Of course it is also possible to provide cross bars 18 with a central section formed by extendable and retractable members as a function of the diameter of the pipe 11.

According to a further modification of the present invention, instead of the disgregating rippers or ploughs, the excavating shovels can be formed with shaped side extensions, having the identical function of the said first series of rippers 39, with the addition of the dredging or sucking action.

Such a modification can be particularly advantageous in the case of sandy and poorly coherent beds.

These side extensions can be in form of tubes shaped in form of clarinet spout, possibly provided with a cutting edge.

Alternatively, small excavating shovels can be provided instead of the disgregating rippers, there shovels being independent from the structural point of view from the true dredging shovels; these auxiliary shovels can be either fixed or movable between a rest position and a working position.

Lastly it is to be pointed out that further modifications and variations of the apparatus of the invention, both as to the structure and with respect to the combination of several features, are possible and foreseable, these modifications and variations being in the range of the man skilled in the art.

I claim:

1. Apparatus for the subaqueous entrenching of pipes, of the type generally comprising a framework, which can be positioned across the pipe to be entrenched, excavating means mounted to the framework and adapted to act along both sides of the pipe already laid onto the bed at least at the position of the framework, so as to form two trenches of predetermined depth, adjacent and parallel to the pipe itself, rippers or ploughs, adapted to disgregate the bed zone directly under the pipe, and a pump for the removal of the material excavated by the excavating means, wherein the framework comprises at least two skid members for the side support and the adjustment of the maximum excavating depth, said skid members being of adjustable height with respect to that of the excavating or dredging means; a first series of disgregating rippers, mounted to vertical rods, driven by levers actuated by ram units and movable between a rest position, in which the rippers are essentially parallel and laterally displaced with respect to the pipe, and an operating position in which the rippers engage the bed zone immediately below the pipe to be entrenched; excavating shovels, forming said excavating means, which are mounted in pairs symmetrically with respect to the framework and in the number of two or more shovels for each side of the framework, each shovel having an excavating edge at a level predetermined and lower with respect to the level of the excavating edge of the next preceding shovel with respect to the dragging direction of the framework; means for the adjustment of the distance between the two internal sides of the framework, said adjustment depending on the diameter of the pipe to be entrenched; a second series of disgregating rippers, which are provided at least in the fore part of the framework and protrude downwardly, in order to engage the bed before the dredging shovels.

2. Apparatus according to claim 1, wherein said skid members consist of lengths linked to each other by means of hinges having horizontal axes or through universal joints.

3. Apparatus according to claim 1, wherein said skid members are connected to the cross bars of the framework through vertical or inclined uprights, formed by ram units having extendable and retractable pistons, the free end of the pistons being pivotally connected to the skid member.

4. Apparatus according to claim 1 or 2, including devices sensing the pressure of the surrounding water mounted to the side skid members.

5. Apparatus according to claim 4, wherein said devices consist of panels sensing the pressure sidewise acting against the framework, said panels being connected to detecting instruments mounted aboard of the dragging and control pontoon.

6. Apparatus according to claim 1, wherein, upstream of each group of rollers for the guide and the sliding motion of the framework with respect to the pipe to be entrenched, a funnel like device is provided, which is open along a generatrix and hinged along the diametrally opposed generatrix, said device being tapered towards the adjacent group of rollers.

7. Apparatus according to claim 1, including probe means associated to the said first series of rippers, said probe means being capable of calibration and being actuatable upon contacting the pipe to be entrenched, so as to bring the rippers back to rest position.

8. Apparatus according to claim 1, wherein said rippers of said first series are rearwardly retractable.

9. Apparatus according to claim 1, wherein each excavation shovel is associated to a pneumatic pump body.

10. Apparatus according to claim 1, wherein said second series of rippers is provided before each dredging shovel, the rippers being positioned at staggered heights.

11. Apparatus according to claim 1, wherein at least to the fore dredging shovels there are mounted devices generating a vibrating motion.

12. Apparatus according to claim 11, wherein said devices generating a vibrating motion are mounted to the said second series of rippers.

13. Apparatus according to claim 11 or 12, wherein said dredging shovels or said rippers are connected to the framework through elastic joints.

14. Apparatus according to claim 1, including an opening is formed in each dredging shovel, water being fed to the inner cavity of the same shovel through said opening.

15. Apparatus according to claim 14, wherein said opening is connected to a small pipe for the water feeding, under adjustable conditions of pressure and flow rate, the said small pipe of each shovel being connected to a common header.

16. Apparatus according to claim 1, wherein the outlet duct of each shovel is connected to a discharge pump, and including a delivery pipe which is extended rearwardly to the framework, with reference to the dragging and thus to the dredging direction, so as to discharge the dredged material on the already entrenched pipe at a distance not less than that at which the pipe has the final stable configuration with respect to the bed.

17. Apparatus according to claim 16, wherein said delivery pipe is supported at a predetermined depth by means of buoys.

18. Apparatus according to claim 16 or 17, wherein the discharge end of the delivery pipe is enlarged in order to slow the speed of the material being discharged.

19. Apparatus according to claim 16, wherein said delivery pipe is supported at the discharge end by a supporting and sliding structure.

20. Apparatus according to claim 1, comprising pairs of fore and/or rear arms, articulated to the framework and maintained into contact with the surface of the pipe to be entrenched through sliding contact means, preferably through rollers.

21. Apparatus according to claim 1, including a tank is centrally mounted to the said framework, the tank being fed either with air under pressure or with ballast liquid.

22. Apparatus according to claim 1, characterized including a device for the cutting of algae provided with cutting disks is mounted forwardly of the framework.

23. Apparatus for burying a pipeline under water, the pipeline being first laid on the bottom comprising:

a framework extending generally transverse to the longitudinal direction of said pipeline;

means for guiding said framework in a direction along the longitudinal direction of said pipeline;

first and second means attached to said framework for excavating first and second trenches alongside opposed sides of said pipeline;

first and second support means resting on the bottom respectively outboard of said first and second means for excavating, said first and second support means being effective to control a depth of said first and second trenches; and means for varying a height of said first and second support means with respect to said framework whereby said depth is correspondingly varied.

24. An apparatus according to claim 23, wherein said first and second support means include at least first and second skids operatively parallel to said pipeline.

25. An apparatus according to claim 24, wherein said first and second skids include first and second tanks respectively each of said first and second tanks being adapted for alternatively receiving one of ballast and buoyant material.

26. An apparatus according to claim 24, wherein said first skid includes a first pair of skids at said first side of said pipeline and said second skid includes a second pair of skids at said second side of said pipeline.

27. An apparatus according to claim 23, wherein said first and second means for excavating each includes at least first and second excavating shovels aligned in said direction, said first excavating shovel being more advanced in said direction than said second excavating shovel, said second shovel being positioned lower than said first shovel.

28. An apparatus according to claim 27, wherein said first and second shovels of said first means for excavating are respectively aligned in a direction transverse to said pipeline with said first and second shovels of said second means for excavating.

29. An apparatus according to claim 28, further comprising at least first and second ripper blades at facing aligned inner positions on said first and second means for excavating below said pipeline and means for concertedly rotating said first and second ripper blades from first positions substantially parallel to said direction to second positions toward each other and substantially transverse to said direction, said first and second ripper blades being effective to disgregate a portion of said bottom lying below said pipeline between said first and second trenches.

30. An apparatus according to claim 29, further including means for sensing the presence of said pipeline in the vicinity of said first and second ripper blades and means for disabling said means for concertedly rotating in response to said means for sensing whereby damage to said pipeline and said first and second ripper blades are avoided.

31. An apparatus according to claim 23, wherein said means for guiding includes at least one of fore and aft arms extending in said direction and opposite to said direction respectively, and guide members on said fore and aft arms, said guide members guidingly contacting said pipeline.

32. An apparatus according to claim 23, further comprising means at an advancing side of said framework for cutting marine growth.

33. An apparatus according to claim 23, further including means for sensing water pressure transverse to said framework whereby skewing of the apparatus with respect to said direction is sensed.

34. An apparatus according to claim 23, wherein said first and second means for excavating include suction pumps, a discharge line having a discharge opening for discharging removed material, and means for positioning said discharge opening above said pipeline at a position far enough from said first and second means for excavating that said pipeline has assumed its final position below said bottom.

35. An apparatus according to claim 34, wherein said means for positioning includes at least one float effective to support said discharge line.

36. An apparatus according to claim 34, wherein said means for positioning includes guide means guidingly contacting said pipeline.

37. An apparatus according to claim 34, wherein said discharge opening includes an enlargement which is effective to decrease a velocity of said removed material whereby a tendency of said discharged material to become suspended in said water is reduced.

38. An apparatus according to claim 23, wherein said framework includes means for adjustment of the transverse width thereof in proportion to a dimension of said pipeline.

39. An apparatus according to claim 23, further comprising a funnel-type device on said framework substantially encircling said pipeline in advance of said means for guiding and having an opening which tapers from narrow to wide in said direction, said funnel-type device being effective to compress flexible material toward said pipeline.

40. An apparatus according to claim 39, wherein said funnel-type device includes two portions hinged connected together along a line substantially parallel to said direction.

41. An apparatus according to claim 23, further comprising means for imparting vibration to said first and second means for excavating.

42. An apparatus according to claim 23, further comprising means for imparting buoyancy to said apparatus.

43. An apparatus according to claim 42, wherein said means for imparting buoyancy includes at least one tank and means for admitting at least one of buoyant and ballast material to said at least one tank.

* * * * *